US009909825B2

(12) United States Patent
Bercea et al.

(10) Patent No.: US 9,909,825 B2
(45) Date of Patent: Mar. 6, 2018

(54) HEAT EXCHANGER FOR A TRANSFORMER

(75) Inventors: Emil Bercea, Bad Honnef (DE); Bo Aström, Guarulhos SP (BR)

(73) Assignee: ABB Schweiz AG, Baden (CH)

( * ) Notice: Subject to any disclaimer, the term of this patent is extended or adjusted under 35 U.S.C. 154(b) by 2823 days.

(21) Appl. No.: 11/660,943

(22) PCT Filed: Nov. 7, 2005

(86) PCT No.: PCT/EP2005/011876
§ 371 (c)(1),
(2), (4) Date: Feb. 23, 2007

(87) PCT Pub. No.: WO2006/050886
PCT Pub. Date: May 18, 2006

(65) Prior Publication Data

US 2009/0000763 A1 Jan. 1, 2009

(30) Foreign Application Priority Data

Nov. 10, 2004 (DE) ..... 10 2004 054 180

(51) Int. Cl.

| | |
|---|---|
| ***F25B 37/00*** | (2006.01) |
| ***F28F 27/00*** | (2006.01) |
| *F28D 21/00* | (2006.01) |
| *H01F 27/10* | (2006.01) |

(52) U.S. Cl.
CPC ..... *F28F 27/00* (2013.01); *F28D 2021/0031* (2013.01); *F28F 2265/18* (2013.01); *H01F 27/10* (2013.01)

(58) Field of Classification Search
CPC ..... F28F 27/00; F28F 2265/18; F28D 2021/0031; H01F 27/10
USPC .... 165/11.1, 11.2, 104.33, 45, 71; 62/259.2; 336/55, 84 C, 92, 94
See application file for complete search history.

(56) References Cited

U.S. PATENT DOCUMENTS 2,474,155 A * 6/1949 Melzer ..... F28D 7/06 165/300
3,544,938 A * 12/1970 Ritter et al. ..... 336/92
3,746,079 A 7/1973 Arenson
(Continued)

FOREIGN PATENT DOCUMENTS

| | | |
|---|---|---|
| DE | 29 38 086 C2 | 8/1981 |
| DE | 89 11 078.1 U1 | 1/1990 |
| DE | 196 09 203 A1 | 9/1997 |

*Primary Examiner* — Ljiljana Ciric
(74) *Attorney, Agent, or Firm* — Barnes & Thornburg LLP

(57) ABSTRACT

A heat exchanger for a transformer including a heat exchanger medium, which can be introduced into a heat exchanger element via a feed element, and can be evacuated from the heat exchanging element via a discharge element. A first temperature measurement device measures a temperature of a feed flow of the heat exchanger medium and a second temperature measurement device measures a temperature of a discharge flow of the heat exchanger medium. A first opening is provided in the feed element, inside of which a first temperature probe is positioned at a predetermined location inside the feed flow during operation of the heat exchanger, and a second opening is provided in the discharge element, inside of which a second temperature probe is positioned at a predetermined location in the discharge flow during operation of the heat exchanger.

7 Claims, 1 Drawing Sheet

(56) References Cited

U.S. PATENT DOCUMENTS

| | | | | | |
|---|---|---|---|---|---|
| 4,196,408 | A | * | 4/1980 | Link | 336/94 |
| 4,350,838 | A | * | 9/1982 | Harrold | 165/104.33 |
| 4,512,387 | A | | 4/1985 | Rodriguez et al. | |
| 5,267,606 | A | * | 12/1993 | Cassia | 165/71 |
| 5,613,549 | A | * | 3/1997 | Dolwani | 165/71 |
| 5,730,208 | A | * | 3/1998 | Barban | 165/45 |
| 5,730,356 | A | * | 3/1998 | Mongan | 237/2 A |
| 5,838,881 | A | * | 11/1998 | Nelson et al. | 706/2 |
| 6,031,722 | A | * | 2/2000 | Paradis et al. | 336/84 C |
| 6,523,602 | B2 | * | 2/2003 | Holighaus et al. | 165/45 |
| 6,742,342 | B1 | * | 6/2004 | Bonaquist et al. | 62/259.2 |
| 6,842,718 | B2 | * | 1/2005 | Byrd et al. | 700/299 |
| 7,081,802 | B2 | * | 7/2006 | Bonaquist et al. | 336/55 |
| 8,752,616 | B2 | * | 6/2014 | Kroliczek et al. | 165/104.33 |
| 2001/0032718 | A1 | * | 10/2001 | Sheerin et al. | 165/130 |
| 2002/0021742 | A1 | * | 2/2002 | Maskell | F28F 9/0209 374/145 |
| 2002/0088242 | A1 | * | 7/2002 | Williams | 62/259.2 |
| 2004/0158428 | A1 | | 8/2004 | Byrd et al. | |
| 2014/0166232 | A1 | * | 6/2014 | Al-Hallaj et al. | 165/11.1 |

* cited by examiner

FIG. 1
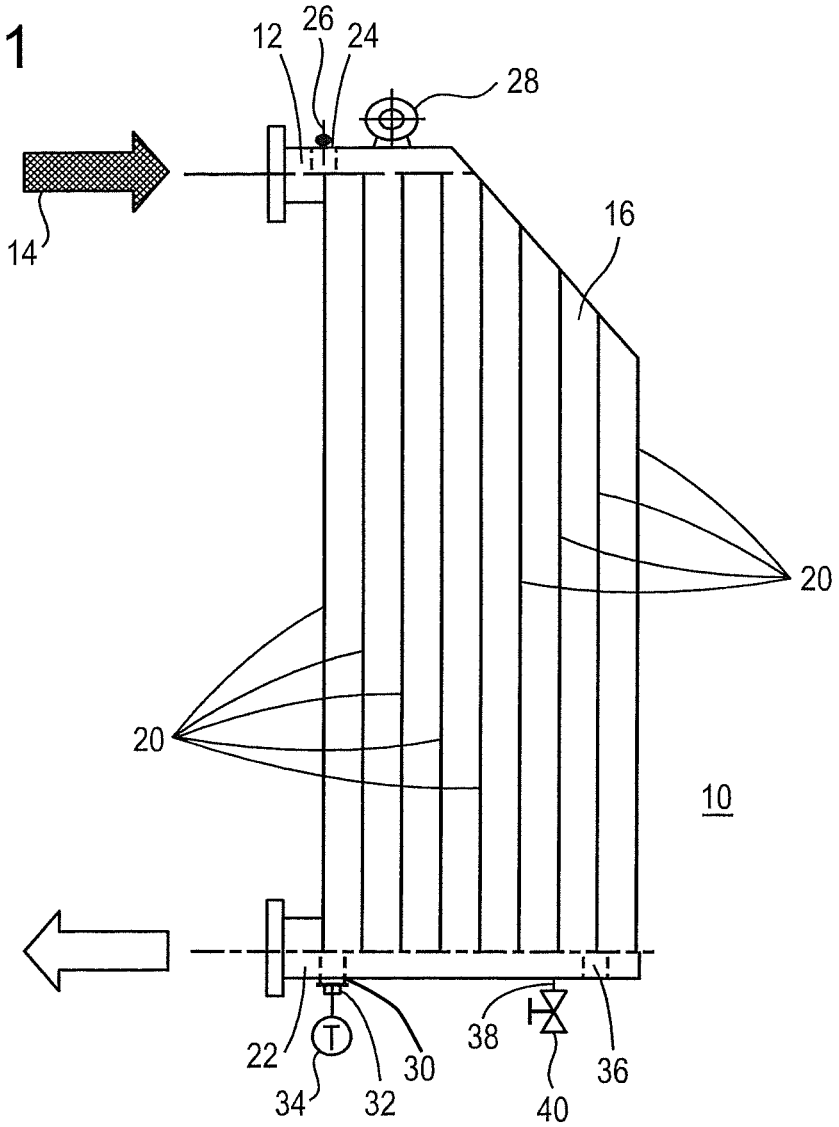
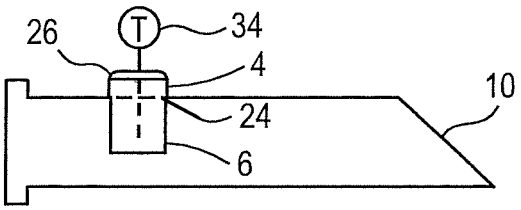
FIG. 2

HEAT EXCHANGER FOR A TRANSFORMER

BACKGROUND

Field of Invention

The invention relates to a heat exchanger, in particular for a transformer, comprising a heat exchanging medium which can be led via a feed element into a heat exchanging element and can be led via a discharge element out of the heat exchanging element, comprising a first temperature measurement of a feed current of the heat exchanger medium and comprising a second temperature measurement of a discharge current of the heat exchanging medium.

Description of Related Art

It is commonly known that transformers can be used for a multiplicity of applications. In particular, power transformers of 5 MVA transformation capacity radiate a considerably quantity of heat during operation, which is usually released into the environment via heat exchangers. For this purpose, a cooling circuit is generally provided, so that the heat exchanger can also, where appropriate, be disposed remote from the transformer.

SUMMARY

A customary configuration of a heat exchanging circuit of this type provides that one or more, often identically designed heat exchangers are respectively supplied with heat exchanging medium via a feed socket. A specially designed surface of the heat exchanger then ensures an optimal heat transfer to a second heat carrier medium, which is also involved in the heat exchanging process as a recooling medium. This can be, for example, the ambient air or, indeed, a liquid, depending on how the heat exchanger is structured.

For the checking of the thermal balance of such heat exchangers, it is prescribed under the general rules of technology and standardization that both the feed temperature of the heat exchanging medium and the discharge temperature of the heat exchanging medium from the heat exchanger are measured. For this purpose, special pipe sections are flange-connected directly to the feed socket and discharge socket, respectively, of the heat exchanger, an immersion sleeve being welded or screwed into these pipe sections, which immersion sleeve receives a thermometer. In an arrangement of this type, the measured temperature in the feed-in and in the outflow, respectively, of the heat exchanger is measured only after a certain time lag, since a temperature change is relayed first to the material of the immersion sleeve and afterwards to the thermometer.

Furthermore, the temperature-measuring pipe sections must be taken into account when planning the design of the transformer. The dimensions of the transformer with the heat exchanger will turn out to be correspondingly sized.

Based on the above prior art, the object of the invention is to define a heat exchanger for a transformer in which the measurement is improved.

BRIEF DESCRIPTION OF THE DRAWINGS

FIG. 1 is a schematic of an exemplary embodiment according to the disclosure; and FIG. 2 is a schematic of an exemplary embodiment of the disclosure.

DETAILED DESCRIPTION

Accordingly, the heat exchanger according to the invention is characterized in that in the feed element there is disposed a first opening, in which, during operation of the heat exchanger, a first temperature probe can be positioned at a predetermined location in the feed current, and in that in the discharge element there is disposed a second opening, in which, during operation of the heat exchanger, a second temperature probe is positioned at a predetermined location in the discharge current.

Consequently, it is provided according to the invention that the temperature measurement is now conducted on the heat exchanger itself. The previously known pipe sections with, respectively, a temperature measuring instrument which, according to the previously known prior art, has been flange-connected to the heat exchanger, are thus dispensed with. In this way, the design is simplified and the options for arranging a heat exchanger with a transformer are increased.

Moreover, the position of the temperature measurement is now directly at the inlet and at the outlet, respectively, of the heat exchanging medium on the heat exchanger, thereby ensuring that the temperatures of the heat exchanging medium are measured in the heat exchanger itself. Possible sources of error or disturbance influences for the temperature measurement, from the previous temperature-measuring point outside the heat exchanger in the pipe sections up to the points on the heat exchanger which are defined according to the invention, are thereby avoided.

In an advantageous embodiment of the subject of the invention, it is provided that in the first opening there is additionally disposed a ventilation device.

For servicing reasons, in connection with filling a heat exchanger with heat exchanger oil, for example, a ventilation device in the form of a ventilation cock or ventilation plug is usually placed at a geodetically high point on the heat exchanger. If the feed current and discharge current, respectively, of the heat exchanger is also realized at a geodetically high point, it is provided according to the invention that the first or the second opening accommodates a combined function element comprising both functions.

One possible embodiment of a dual-function element consists in the emptying device being configured such that the temperature probe can be inserted through it or past it into the feed and discharge element, respectively, so that the particular temperature probe reaches its predetermined position. The corresponding embodiments of the ventilation device are known to the person skilled in the art.

The structure of the heat exchanger as a whole is thereby simplified. The creation of an additional opening for a separate ventilation device is dispensed with.

It is particularly advantageous if the first and/or the second opening has a sealing element, through which the corresponding temperature probe can be inserted in a heat-exchange-medium-tight manner.

In this inventive embodiment of the heat exchanger, the hitherto customary immersion sleeve, which prevents an escape of heat exchanging medium from a closed system, is avoided. An arrangement of this type, moreover, enables the temperature measurement to be realized directly in the heat exchanger medium. A dead time in the temperature measurement, caused by the immersion sleeve, is avoided.

Further advantageous embodiments of the heat exchanger according to the invention can be derived from the further dependent claims.

The invention, an advantageous embodiment thereof and improvements of the invention, as well as particular advantages of the invention, shall be explained and described in greater detail with reference to the illustrative embodiment represented in the drawing, wherein:

the single FIGURE shows a transformer cooler.

The single FIGURE shows a cooler 10, which serves as a recooler for a cooling circuit of a power transformer, neither the power transformer nor other details of the cooling circuit being represented in this FIGURE. The power transformer recooled with the cooler 10 has a transformation capacity of about 15 MVA, in the illustrated example the single cooler 10 being adequately dimensioned for the recooling of the heat generated by the power transformer.

It is readily conceivable, however, that, if necessary, a plurality of such coolers 10 are connected in parallel in the cooling circuit or that a heat exchanger face commensurate to the cooling requirements is fitted to the cooler 10, so that the cooling capacity of this unit is suitably increased.

The illustrated example shows the cooler 10 as an upright heat exchanger, so that by at the bottom in the FIGURE is meant geodetically "at the bottom". Accordingly in the FIGURE, at the top of the cooler 10, a feed socket 12 is shown, the flow direction of the inflowing coolant being indicated by a first arrow 14. The feed socket 12 is configured as a pipe section, which, on the one hand, is connected to a cooler element 16 and, on the other hand, has a first flange 18 provided, in particular, for direct connection to the power transformer or a connecting pipe of the coolant circuit.

The inflowing coolant, in this example a heat exchanger oil, which is often used in transformer cooling circuits, flows through the feed socket 12 to the cooler element 16, whereupon the coolant current is divided into a plurality of ribs 20, so that a plurality of coolant currents are formed, running from top to bottom through the cooling element 16. In the lower region of the cooling element 16, the coolant subcurrents reconverge into a common discharge current. This common discharge current makes its way through a discharge socket 22 back to the power transformer or into the coolant circuit.

In order to reinforce the cooling effect, the ribs 20 can be blown through, for example by a forced convection flow, by the air which surrounds them. For this, fans (not represented in this FIGURE) are normally used, the generated air current of which is sufficiently strong that a desired temperature of the coolant is established in the discharge current.

At the highest point of the pipe in the feed socket 12, namely approximately at the interface between the pipe section and the cooler element 16, a first opening 24 is disposed in the feed socket 12. In the chosen representation, the first sealing element 26, which is disposed in the first opening 24, is also shown. With this first sealing element 26, a combined apparatus comprising ventilation element and thermocouple can be inserted in a medium-tight manner into the first opening 24.

The ventilation device is necessary, particularly in the filling of the coolant circuit or of the cooler 10, to ventilate the air collecting at the highest points of the particular circuit or of the cooler 10, which air is gradually displaced by the cooling medium filled into the coolant circuit. The adoption of a further technical function, which, according to the invention, can be realized at the same point in the first opening 24, is the temperature measurement with a first thermocouple. According to the invention, the first thermocouple can now be brought to a position in the pipe section of the feed socket 12 which, according to the invention, best corresponds to the actual feed temperature of the cooler 10. Moreover, the first sealing element 26 seals the first thermocouple in the region of the first opening 24 against a possible escape of coolant from the cooling system. In this example, the otherwise necessary immersion sleeve 6 for sealing an opening in a pipe is avoided. The measurement value recording is thereby made directly by the thermocouple in the coolant and not indirectly via the material of the immersion sleeve and, hence, such that it is damped and time-delayed. The measurement has in this way become more accurate and faster.

In the illustrated example, yet another advantage is apparent. In the upper region of the cooling element 16 there is also shown an eyelet 28, by which, for example in the assembly operation, the complete cooler 10 can be hung from a hoist. Due to the space-saving dual function of temperature measurement and ventilation in the first opening 24, moreover, no further space is required, from the design aspect, in the upper region of the cooling element 16. Thus, a greater design freedom also exists, namely with respect to a design of the cooling element 16, for example in its beveled upper region, as represented. In the chosen example, this design takes into account a special spatial assembly requirement relating to the place of installation of the cooler 10.

In the lower region, the two functions of temperature measurement and coolant run-off are realized at various positions. Thus, a second opening 30 is disposed on a lowly point of the pipe section of the discharge socket 22 and is provided with a second sealing element 32. The second sealing element 32 is designed with a ductile plastic compound and fully closes off the second opening 30, so that no coolant in the inner region of the cooling element 16 or of the discharge socket 22 is able to escape, even if there is no thermocouple inserted. The plastic compound is made sufficiently ductile, however, and is provided with a further opening, to enable the rod-like part of a second thermocouple to be inserted through the plastic compound and the second opening 30 and to be fixed in a desired position.

For the fixing there are various options available, for example that the rod-like part of the thermocouple is provided with an appropriate stop or with an appropriate screw connection. Further fixing options are known to the person skilled in the art. In the FIGURE, the thermocouple 34 is shown in purely symbolic representation. A third opening 36 is likewise arranged on a lower point of the cooler element 16, yet at a sufficient distance from the second opening 30 that the devices introduced into the openings 30, 36 do not influence or disturb one another. To the third opening 36 there is connected a connection element 38, which is suitable for receiving a drainage device, here a shut-off valve 40. The shut-off valve 40 is represented merely as a symbol and is constructed, for example, as a shut-off ball cock or shut-off slide valve.

With the above-described arrangement according to the invention, it is possible to conduct very accurate temperature measurements directly in the feed and discharge currents of the cooler 10 in a particularly simple manner. Such measurements on coolers are normally prescribed by standards, to allow the functionality of a heat exchanger to be monitored. One option for processing the measurement data consists in relaying these to a process control system of the transformer, of the coolant circuit or of an integrated plant, which process control system carries out the evaluation of the measurement and, if necessary, also the editing of the measurement data. Moreover, the option exists of further processing of the measurement data, for example by the formation of temperature differences or statistical analyses. These functions can also be performed on the spot by appropriate measuring instruments. These are not, however, represented in the FIGURE. In any event, the measurement value recording in the specified manner is an improvement on that which has hitherto been known.

| Reference symbol list | |
|---|---|
| 10 | cooler |
| 12 | feed socket |
| 14 | first arrow |
| 16 | cooling element |
| 18 | flange |
| 20 | ribs |
| 22 | discharge socket |
| 24 | first opening |
| 26 | first sealing element |
| 28 | eyelet |
| 30 | second opening |
| 32 | second sealing element |
| 34 | thermocouple |
| 36 | third opening |
| 38 | connection element |
| 40 | shut-off valve |

The invention claimed is:

1. A heat exchanger for a transformer, comprising:

a heat exchanging element including:

a feed element having a first opening; and a discharge element having a second opening, the heat exchanging element being configured for introducing a heat exchange medium feed current into the heat exchanging element via the feed element and discharging a heat exchange medium discharge current from the heat exchanging element via the discharge element;

a first temperature measurement device arranged in the first opening for insertion in the heat exchange medium feed current for measuring a temperature of the heat exchange medium feed current; and a second temperature measurement device arranged in the second opening for insertion in the heat exchange medium discharge current for measuring a temperature of the heat exchange medium discharge current; and a ventilation device disposed in the first opening.

2. The heat exchanger as claimed in claim 1, comprising:

a ventilation device disposed in the second opening.

3. A heat exchanger for a transformer, comprising:

a heat exchanging element including:

a feed socket having a first opening; and a discharge socket having a second opening, the heat exchanging element being configured for introducing a heat exchange medium feed current into the heat exchanging element via the feed socket and discharging a heat exchange medium discharge current from the heat exchanging element via the discharge socket;

a first temperature measurement device arranged in the first opening for insertion in the heat exchange medium feed current for measuring a temperature of the heat exchange medium feed current; and a second temperature measurement device arranged in the second opening for insertion in the heat exchange medium discharge current for measuring a temperature of the heat exchange medium discharge current.

4. The heat exchanger as claimed in claim 3, comprising:

a ventilation device disposed in the first opening.

5. The heat exchanger as claimed in claim 3, comprising:

a ventilation device disposed in the second opening.

6. The heat exchanger as claimed in claim 3, comprising:

a sealing element, arranged in each of the first opening and second opening for sealing the corresponding temperature measurement device in a heat-exchange medium-tight manner.

7. The heat exchanger as claimed in claim 3, wherein the temperature measurement devices are thermocouples.

* * * * *